US006317669B1

(12) United States Patent
Kurenuma et al.

(10) Patent No.: US 6,317,669 B1
(45) Date of Patent: Nov. 13, 2001

(54) AUTOMATICALLY OPERATED SHOVEL

(75) Inventors: Tooru Kurenuma, Tsuchiura; Yoshiyuki Nagano; Hideto Ishibashi, both of Ibaraki, all of (JP)

(73) Assignee: Hitachi Construction Machinery Co. Ltd. (JP)

( * ) Notice: Subject to any disclaimer, the term of this patent is extended or adjusted under 35 U.S.C. 154(b) by 0 days.

(21) Appl. No.: 09/697,423

(22) Filed: Oct. 27, 2000

(30) Foreign Application Priority Data

Oct. 28, 1999 (JP) ..... 11-307221

(51) Int. Cl.[7] ..... E02F 9/20
(52) U.S. Cl. ..... 701/50; 37/414; 172/2
(58) Field of Search ..... 701/50; 37/348, 37/444, 414; 414/699; 172/4.5, 2

(56) References Cited

U.S. PATENT DOCUMENTS 5,356,259 * 10/1994 Hanamoto et al. ..... 414/694
5,782,018 * 7/1998 Tozawa et al. ..... 37/348

* cited by examiner

*Primary Examiner*—Tan Nguyen

(57) ABSTRACT

An automatically operated shovel has a shovel and an automatic operation controller arranged on the shovel to store by a teaching operation plural working positions of the shovel, which comprises at least a digging position, and also to cause by a reproduction operation the shovel to repeatedly perform a series of reproduction operations on the basis of the stored plural working positions. The automatic operation controller is provided with servo control means for outputting, as a servo control quantity, a sum of a compliance control quantity and a pressure control quantity. The compliance control quantity is obtained by multiplying with a stiffness gain a difference between a target position of each operational element of the shovel, the target position comprising angle information indicative of an operational target of the operational element, and a current position of the operational element, the current position comprising current angle information on the operational element. The pressure control quantity is obtained by multiplying with a pressure gain a difference between a target pressure, which serves as a target when the operational element of the shovel is in contact with an object under digging, and a current pressure of the operational element. The stiffness gain and the pressure gain are settable at varied values depending on the working positions.

24 Claims, 12 Drawing Sheets

AUTOMATICALLY OPERATED SHOVEL

BACKGROUND OF THE INVENTION a) Field of the Invention

This invention relates to an automatically operated shovel, and especially to an automatically operated shovel improved in digging performance.

b) Description of the Related Art

Power shovels are known as a representative example of construction machinery for many years. In recent years, power shovels are designed to perform work by an automated operation when the work consists of repetitions of a series of simple work ranging from digging to hauling or dumping. To permit an automatic operation of a power shovel, however, there are a variety of problems which must be solved.

For example, an object under digging may be soft like soil, may comprise soft portions and hard portions mixed together like soil and rocks, or may comprise only hard portions like rocks cut off from a working face. To assure an efficient, stable operation of an automatically operated shovel under control irrespective of the conditions of the object under digging, certain measures are required.

To meet such requirements, a method is proposed in JP 7-259117 A. This method features generation of control command values in an automatic digging apparatus on the basis of values preset depending on various soil conditions, respectively. These various soil conditions correspond to objects under digging in the present invention. Described more specifically, this apparatus is provided with hydraulic cylinders for operating a boom, an arm and a bucket, respectively, and also with a lookup table having, for example, control characteristics such that the boom is not raised within a range where the pressure of a cylinder for the arm is low but a command value for a boom-raising speed is changed proportionally depending on the condition of soil when the pressure exceeds a predetermined value. It is disclosed that based on a detected arm pressure, a command value is outputted for the control of the boom cylinder in accordance with the corresponding control characteristics set in the lookup table. In this prior art, the lookup table has to be set by making reference to soil conditions from time to time or has to be set separately in a different manner.

The method of the above-described conventional art, therefore, requires advance setting of soil conditions. It is hence necessary to furnish information on the soil conditions by a certain method. For example, with respect to soil and rocks cut out from a working front at a quarry, it is necessary to determine by a suitable method whether the soil and rocks contain more soil or more rocks. No problem arises for this determination in the case of a digging apparatus which is attended by an operator and automatically performs only digging. In the case of a fully operatorless digging apparatus, a system is additionally required to determine conditions of soil, resulting in a more complex and costly digging apparatus. Even if such a system is employed, it is still difficult to determine the kind of an object under digging on a real-time basis when the object under digging is not homogeneous at all like stone-mixed soil.

SUMMARY OF THE INVENTION

With the above-described various problems in view, the present invention has as an object the provision of an automatically operated shovel which can perform optimal servo control at a series of working positions and can effectively perform stable digging irrespective of the kind of an object under digging.

In one aspect of the present invention, there is thus provided an automatically operated shovel having a shovel and an automatic operation controller arranged on the shovel to store by a teaching operation plural working positions of the shovel, which comprises at least a digging position, and also to cause by a reproduction operation the shovel to repeatedly perform a series of reproduction operations on the basis of the stored plural working positions, wherein:

the automatic operation controller is provided with servo control means for outputting, as a servo control quantity, a sum of a compliance control quantity and a pressure control quantity, said compliance control quantity having been obtained by multiplying with a stiffness gain a difference between a target position of each operational element of the shovel, said target position comprising angle information indicative of an operational target of the operational element, and a current position of the operational element, said current position comprising current angle information on the operational element, and the pressure control quantity having been obtained by multiplying with a pressure gain a difference between a target pressure, which serves as a target when the operational element of the shovel is in contact with an object under digging, and a current pressure of the operational element; and the stiffness gain and the pressure gain are settable at varied values depending on the working positions. As the stiffness gain and pressure gain of each operational element of the shovel, that is, the main body of the automatically operated shovel are settable at varied values depending on the working positions, it is possible to perform optimal servo control in the series of reproducing operations by setting optimal stiffness gain and pressure gain for each working position.

As servo control of a boom at the digging position, pressure control may be performed by setting a stiffness gain for the boom at 0 or substantially 0 and a pressure gain for the boom at a first predetermined value before the bucket comes into contact with the object under digging, and compliance control and pressure control may be performed by setting the stiffness gain for the boom at a predetermined value and the pressure gain for the boom at a second predetermined value after the bucket has come into contact with the object under digging. According to this preferred embodiment, the object under digging can be smoothly and automatically dug irrespective of the conditions of the object. Further, the shovel is not jacked up during the digging so that an operatorless, continuous, automatic operation is feasible without positional deviation. Moreover, the digging can be performed with jack-up free, maximum digging force, thereby assuring good operation efficiency. Even if the object under digging varies in height, the digging can be continued following such height variations. If digging loads are low, the bucket can be operated drawing a locus as intended. Even if there is an obstacle on the course of the digging, the bucket can continue the digging by automatically circumventing the obstacle. It is therefore possible to perform the digging work without paying attention to the conditions of the object under digging.

In another preferred embodiment, the predetermined value set as the stiffness gain for the boom after the bucket has come into contact with the object under digging may be set at a value smaller than a value of the stiffness gain set for the boom at a working position other than the digging position. According to this preferred embodiment, the object under digging can be smoothly and automatically dug irrespective of the conditions of the object. Further, the shovel is not jacked up during the digging so that an operatorless, continuous, automatic operation is feasible without positional deviation. Moreover, the digging can be performed with jack-up free, maximum digging force, thereby assuring good operation efficiency. Even if the object under digging varies in height, the digging can be continued following such height variations. If digging loads are low, the bucket can be operated drawing a locus as intended. Even if there is an obstacle on the course of the digging, the bucket can continue the digging by automatically circumventing the obstacle. It is therefore possible to perform the digging work without paying attention to the conditions of the object under digging.

As servo control of aboomat the digging position, pressure control may be performed by setting a stiffness gain for the boom at 0 or substantially 0 and a pressure gain for the boom at a first predetermined value before the bucket comes into contact with the object under digging, a time until the bucket comes into contact with the object under digging maybe measured, and if the time so measured is longer than a predetermined time, an operation of the shovel may be stopped. According to this preferred embodiment, the safety of the automatically operated shovel during the digging can be improved.

As servo control of a boom at the digging position, pressure control may be performed by setting a stiffness gain for the boom at 0 or substantially 0 and a pressure gain for the boom at a first predetermined value before the bucket comes into contact with the object under digging, a distance or angle until the bucket comes into contact with the object under digging may be measured, and if the distance or angle so measured is greater than a predetermined distance or a predetermined angle, an operation of the shovel may be stopped. According to this preferred embodiment, the safety of the automatically operated shovel during the digging can be improved.

As servo control of a swivel superstructure at the digging position, compliance control may be performed by setting a stiffness gain for the swivel superstructure at a first predetermined value and a pressure gain for the swivel superstructure at 0 or substantially 0 before the bucket comes into contact with the object under digging, and compliance control and pressure control may be performed by setting the stiffness gain for the swivel superstructure at a second predetermined value and the pressure gain for the swivel superstructure at a predetermined value after the bucket has come into contact with the object under digging. According to this preferred embodiment, it is possible to avoid a positional deviation from a swiveling direction during the digging and hence to permit an operatorless, continuous operation.

In a still further preferred embodiment, the second predetermined value of the stiffness gain set for the swivel superstructure after the bucket has come into contact with the object under digging may be set at a value smaller than the value of the stiffness set for the swivel superstructure at a working position other than the digging position and the first predetermined value of the stiffness gain for the swivel superstructure. According to this preferred embodiment, it is also possible to avoid a positional deviation from a swiveling direction during the digging and hence to permit an operatorless, continuous operation.

In another aspect of the present invention, there is also provided an operation method of an automatically operated shovel having a shovel and an automatic operation controller arranged on the shovel to store by a teaching operation plural working positions of the shovel, which comprises at least a digging position, and also to cause by a reproduction operation the shovel to repeatedly perform a series of reproduction operations on the basis of the stored plural working positions, the automatic operation controller is provided with servo control means for outputting, as a servo control quantity, a sum of a compliance control quantity and a pressure control quantity, said compliance control quantity having been obtained by multiplying with a stiffness gain a difference between a target position of each operational element of the shovel, said target position comprising angle information indicative of an operational target of the operational element, and a current position of the operational element, said current position comprising current angle information on the operational element, and the pressure control quantity having been obtained by multiplying with a pressure gain a difference between a target pressure, which serves as a target when the operational element of the shovel is in contact with an object under digging, wherein servo control of a boom at the digging position comprises the following steps:

performing pressure control by setting a stiffness gain for the boom at 0 or substantially 0 and a pressure gain for the boom at a first predetermined value before the bucket comes into contact with the object under digging; and performing compliance control and pressure control by setting the stiffness gain for the boom at a predetermined value and the pressure gain for the boom at a second predetermined value after the bucket has come into contact with the object under digging. According to this method, the object under digging can be smoothly and automatically dug irrespective of the conditions of the object. Further, the shovel is not jacked up during the digging so that an operatorless, continuous, automatic operation is feasible without positional deviation. Moreover, the digging can be performed with jack-up free, maximum digging force, thereby assuring good operation efficiency. Even if the object under digging varies in height, the digging can be continued following such height variations. If digging loads are low, the bucket can be operated drawing a locus as intended. Even if there is an obstacle on the course of the digging, the bucket can continue the digging by automatically circumventing the obstacle. It is therefore possible to perform the digging work without paying attention to the conditions of the object under digging.

In a preferred embodiment, the predetermined value set as the stiffness gain for the boom after the bucket has come into contact with the object under digging may be set at a value smaller than a value of the stiffness gain set for the boom at a working position other than the digging position. According to this preferred embodiment, the object under digging can be smoothly and automatically dug irrespective of the conditions of the object. Further, the shovel is not jacked up during the digging so that an operatorless, continuous, automatic operation is feasible without positional deviation. Moreover, the digging can be performed with jack-up free, maximum digging force, thereby assuring good operation efficiency. Even if the object under digging varies in height, the digging can be continued following such height variations. If digging loads are low, the bucket can be operated drawing a locus as intended. Even if there is an obstacle on the course of the digging, the bucket can continue the digging by automatically circumventing the obstacle. It is therefore possible to perform the digging work without paying attention to the conditions of the object under digging.

In the step in which the pressure control is performed with the pressure gain for the boom being set at the first predetermined value, a time until the bucket comes into contact with the object under digging may be measured, and if the time so measured is longer than a predetermined time, an operation of the shovel may be stopped. According to this preferred embodiment, the safety of the automatically operated shovel during the digging can be improved.

In the step in which the pressure control is performed with the pressure gain for the boom being set at the first predetermined value, a distance or angle until the bucket comes into contact with the object under digging may measured, and if the distance or angle so measured is greater than a predetermined distance or a predetermined angle, an operation of the shovel may be stopped. According to this preferred embodiment, the safety of the automatically operated shovel during the digging can be improved.

In a still further preferred embodiment, servo control of a swivel superstructure at the digging position may comprise the following steps:

performing compliance control by setting a stiffness gain for the swivel superstructure at a first predetermined value and a pressure gain for the swivel superstructure at 0 or substantially 0 before the bucket comes into contact with the object under digging; and performing compliance control and pressure control by setting the stiffness gain for the swivel superstructure at a second predetermined value and the pressure gain for the swivel superstructure at a predetermined value after the bucket has come into contact with the object under digging. According to this preferred embodiment, it is also possible to avoid a positional deviation from a swiveling direction during the digging and hence to permit an operatorless, continuous operation.

In a still further preferred embodiment, the second predetermined value of the stiffness gain set for the swivel superstructure after the bucket has come into contact with the object under digging may be set at a value smaller than the value of the stiffness set for the swivel superstructure at a working position other than the digging position and the first predetermined value of the stiffness gain for the swivel superstructure. According to this preferred embodiment, it is also possible to avoid a positional deviation from a swiveling direction during the digging and hence to permit an operatorless, continuous operation.

DETAILED DESCRIPTION OF THE PREFERRED EMBODIMENTS

The first embodiment of the present invention will be described firstly with reference to FIG. 1 through FIG. 9.

Figure 2:
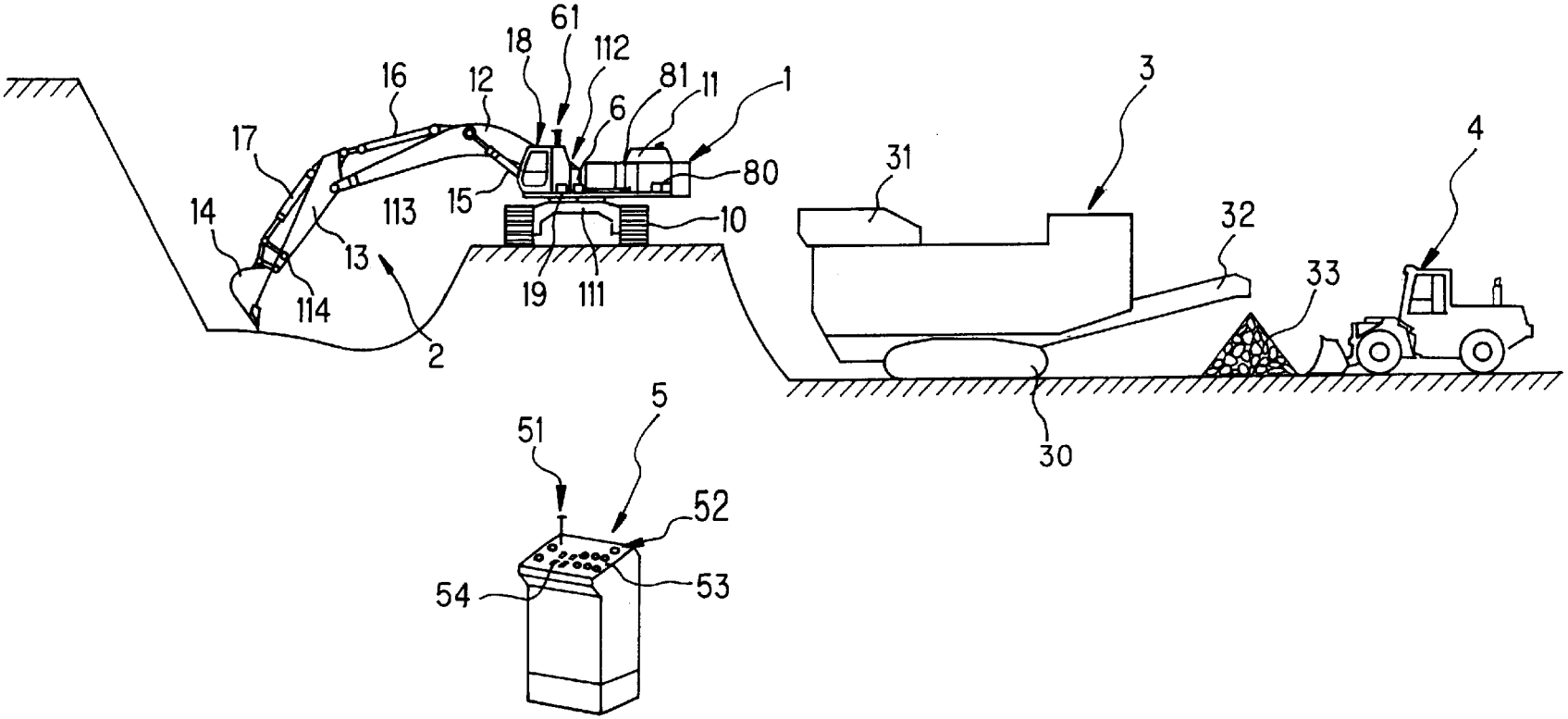
FIG. 2 is a side view illustrating the automatically operated shovel according to each embodiment of the present invention and one example of types of its work.

FIG. 2 shows a main body 1 of the automatically operated shovel which digs guarried rocks or the like accumulated at a stockyard 2 and hauls it into a crusher 3 to be described subsequently herein, the stockyard 2 for permitting accumulation of quarried rocks or the like transported by unillustrated dump tracks or the like, the crusher 3 for crushing quarried rocks hauled from the automatically operated shovel main body 1, a wheeled loader 4 for loading crushed stones on unillustrated transportation dump trucks or the like, and a remote operation system 5 arranged at a desired location suitable for performing reproducing operations by the automatically operated shovel main body 1.

The automatically operated shovel main body 1 is constructed of a travel base 10, a swivel superstructure 11 removably arranged on the swivel superstructure 11, a cab 18 in which an operator sits to perform an operation, a boom 12 pivotally arranged on the swivel superstructure 11, an arm 13 pivotally arranged on a free end of the boom 12, a bucket 14 pivotally arranged on a free end of the arm 13, boom, arm and bucket cylinders 15,16,17 for pivotally operating the boom 12, arm 13 and bucket 14, respectively, a hydraulic motor 19 for permitting turning of the swivel superstructure 11 relative to the travel base 10, an engine 80 as a power source for the automatically operated shovel main body 1, an automatic operation controller 6 for performing control of automatically operating functions, electromagnetic proportional valves 81 for controlling quantities of oil which the automatic operation controller 6 feed to the respective cylinders, and a radio-communication unit 61 for performing transmission/reception of signals with the remote control system 5.

Further, the automatically operated shovel main body 1 is also provided with an angle sensor 111 for detecting a revolved angle of the swivel superstructure 11, an angle sensor 112 for detecting a pivoted angle of the boom 12 relative to the swivel superstructure 11, an angle sensor 113 for detecting a pivoted angle of the arm 13 relative to the boom 13, and an angle sensor 114 for detecting a pivoted angle of the bucket 14 relative to the arm 13.

The crusher 3, on the other hand, is constructed of a travel base 30, a hopper 31 and a conveyor 32, and numeral 33 indicates soil and stones crushed by the crusher 3.

The remote control system 5 is provided with an emergency stop button 52, a reproduction operation section 53 for performing a reproducing operation, an engine control section 54 for controlling the engine speed of the automatically operated shovel main body 1, and a radiocommunication unit 51 for performing transmission/reception of signals between the automatically operated shovel main body 1 and the radio-communication unit 61.

Figure 3:
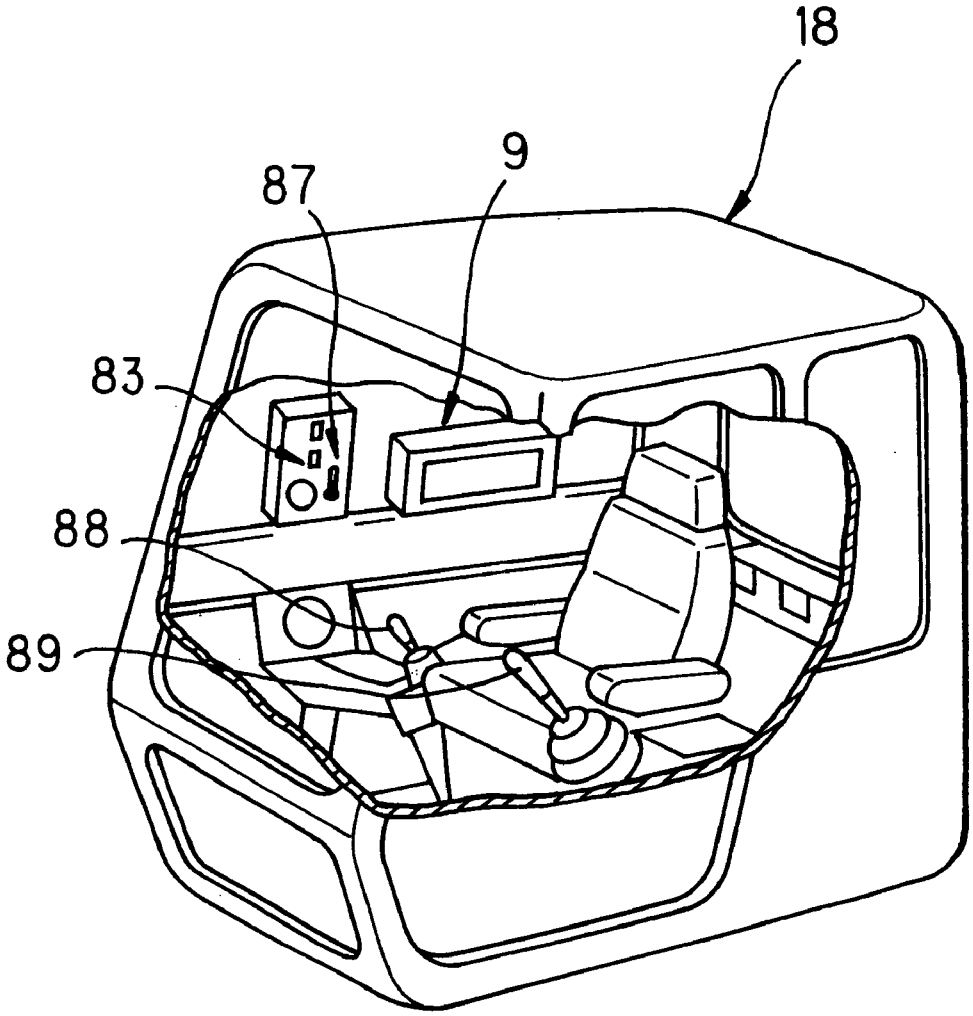
FIG. 3 is a partly cut-away perspective view of a cab shown in FIG. 2, illustrating the interior of the cab.

A description will next be made with reference to FIG. 3. Similarly to conventional hydraulic shovels, the cab 18 is internally provided with control levers 88,89 for operating the swivel superstructure 11, boom 12, arm 13 and bucket 14 as operational elements. Arranged deep inside the cab 18 are a teaching operation unit 9, a cab engine stop button 83, and a power switch 87 of the automatic operation controller 6.

Figure 1:
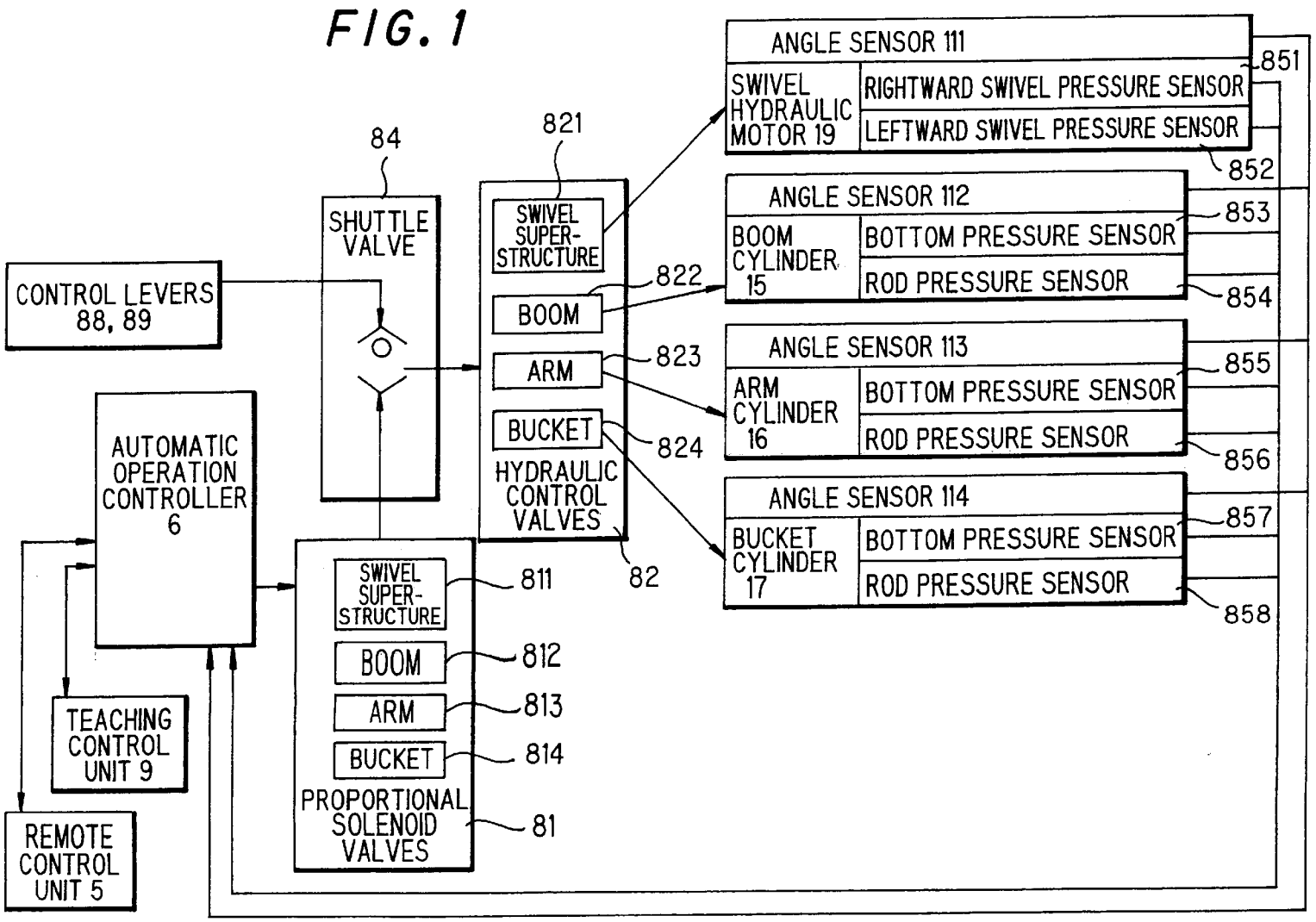
FIG. 1 is a functional block diagram of an automatically operated shovel according to each embodiment of the present invention.

Referring now to FIG. 1, a description will be made about an operation of the automatically operated shovel. The individual operational elements of the automatically operated shovel main body 1 are driven by the turning hydraulic motor 19, boom cylinder 15, arm cylinder 16 and bucket cylinder 17 as actuators, respectively. These actuators are controlled by hydraulic control valves 82, respectively, and two signal routes are arranged to control these hydraulic control valves 82. One of the signal routes is a signal route through which the hydraulic control valves 82 are operated by the control levers 88,89 in a similar manner as in the conventional shovels. According to the other signal route, signals are generated through the teaching operation unit 9 or remote control system 5, the automatic operation controller 6, and the electromagnetic proportional valves 81. Which one of these two signal routes is used is selected by a shuttle valve 84.

Since the automatically operated shovel of this embodiment takes the teaching playback system, target positions during an automated operation are taught by teaching before a playback. As an example of teaching, an operator sits in the cab 18 and guides the respective operational elements of the automatically operated shovel main body 1 by using the control levers 88,89. When the actuators 19,15,16,17 are driven via the shuttle valve 84 and the hydraulic control valves 82, angle signals are detected by the angle sensors 111,112,113,114 arranged on the respective operational elements, and these signals are inputted in the automatic operation controller 6 and stored as target positions in the automatic operation controller 6.

Incidentally, for teaching, the position of the automatically operated shovel main body 1 which is operating under control by an operator may be measured at certain time intervals to obtain target positions, or an operator may guide the individual operational elements to positions needed for an operation during an automated operation and hence to teach the positions, and an interpolating means such as that operable at a separately-designated speed between the target positions so taught may be arranged. It is also possible to perform operations, which are needed for these teaching, through the remote control system or by downloading in the automatic operation controller those separately prepared off line rather than having an operator sat in the cabin 18 and relying on him.

Upon performing a playback, the reproduction operation section 54 of the remote control system 5 is operated. As a result, signals generated based on target positions indicated by the teaching are outputted to the respective electromagnetic proportional valves 81, that is, to the electromagnetic proportional valves 811,812,813,814 for the swivel superstructure 11, boom 12, arm 13 and bucket 14, which through the shuttle valve 84, control the respective hydraulic control valves 82, that is, the hydraulic control valves 821,822,823, 824 for the swivel superstructure 11, boom 12, arm 13 and bucket 14. As a result, the individual actuators 15–17,19 are driven. When the angle sensors 111,112,113,114 and the pressure sensors 15–17,19, which are arranged on the respective actuators, are actuated, signals from the angle sensors 111,112,113,114 mounted on the respective operational elements and those from pressure sensors 851,852, 853,854,855,856,857 are fed back to the automatic operation controller 6. This makes it possible for the automatically operated shovel 1 to perform desired operations.

Figure 4:
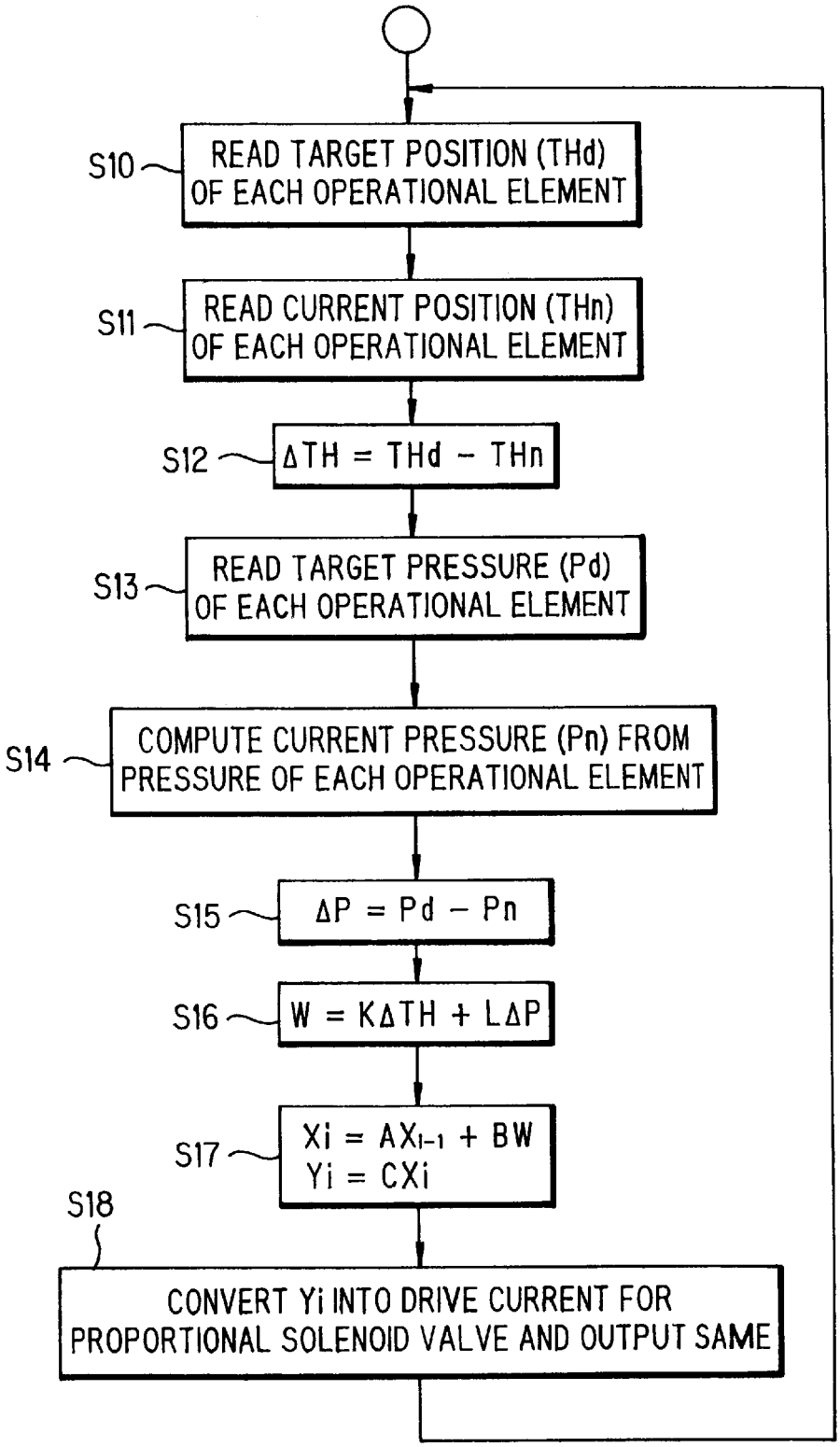
FIG. 4 is a flow chart showing control procedures of servo control of the automatically operated shovel according to each embodiment of the present invention.
Figure 5:
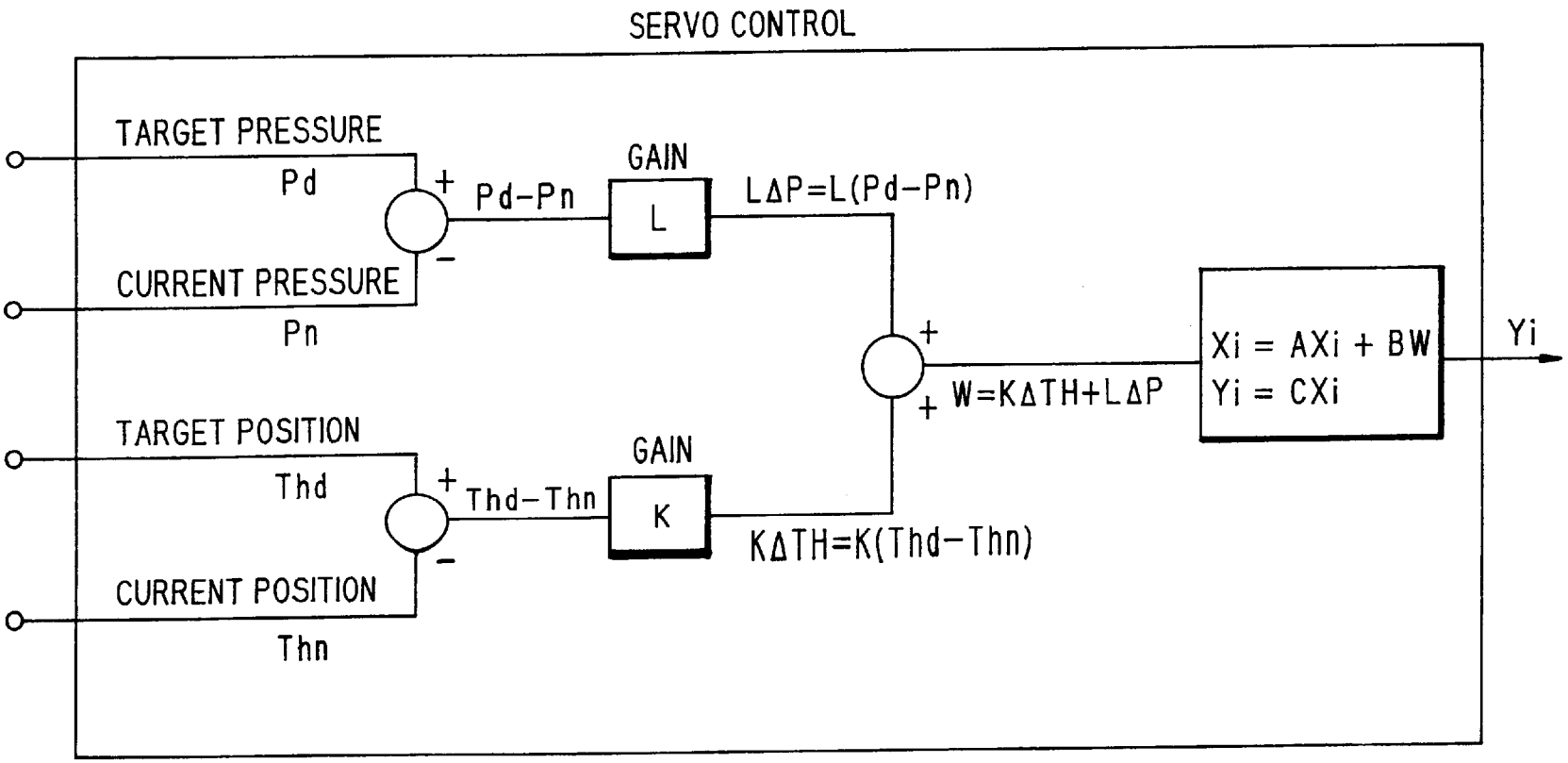
FIG. 5 is a functional block diagram of servo control by the automatically operated shovel according to each embodiment of the present invention.

Referring next to FIG. 4 and FIG. 5, a description will be made about servo control at the automatic operation controller 6 of the automatically operated shovel according to this embodiment. It is to be noted that the operational elements of the automatically operated shovel main body 1 are independently subjected to servo control but the manner of control is common to all the operational elements.

The servo control will now be described with reference to FIG. 4 and FIG. 5.

In step 10, a target position THd which is an operational target of each operational element and comprises angle information is read. In step 11, a current position THn which comprises a current angle of the operational element is next read, and in step 12, a difference between THd and THn is computed to determine TH. In step 13, a target pressure Pd which serves as a target of the state of contact between the operational element and an object under digging is then read. In step 14, a current pressure Pn of the operational element is determined, and in step 15, a difference P between Pd and Pn is determined. In step 16, a product obtained by multiplying TH with a stiffness gain K and a product obtained by multiplying P with a pressure gain L are added to obtain a servo control quantity W. In step 17, computation is performed according to state equations of the discretion system to obtain outputs Xi,Yi. In step 18, the output Yi is converted into a drive current and is outputted to the electromagnetic proportional valve 81.

In W=K TH+L P obtained in step 16, L P corresponds to a pressure control component while K TH corresponds to a position control component. Nonetheless, lowering of the stiffness gain K makes it possible to perform compliance control under which a spring-like behavior can be exhibited. If the stiffness gain K is raised and the pressure gain L is lowered to 0 in this step, usual positional control can therefore be performed. On the other hand, lowering of the stiffness gain K makes less sensitive the response to a deviation, so that the operational element under control can be actuated as if it is actuated via a spring. If the stiffness gain K is lowered to 0 and the pressure gain L alone is set, pressure control can be performed in such a way that the operational element under control is allowed to stay still in a state that reaction force is absorbed. If the stiffness gain K and the pressure gain L are both set, on the other hand, control can be performed as is the operational element under control is preloaded in such a state that the operational element is actuated via a spring.

Figure 6:
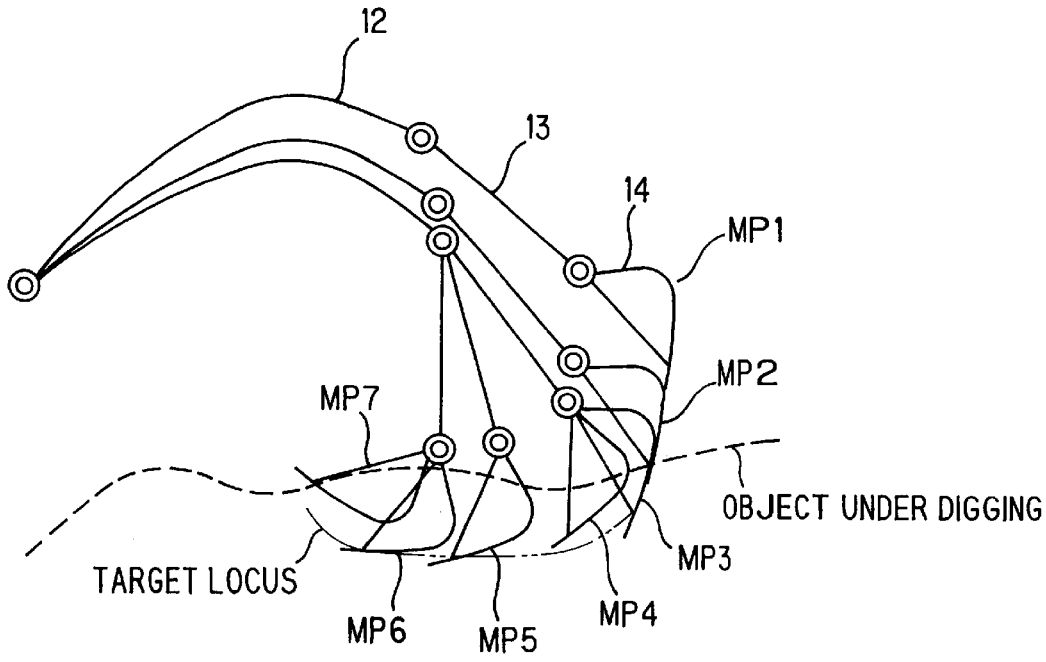
FIG. 6 is a diagram for explaining problems of the conventional art upon digging in comparison with the present invention.
Figure 7:
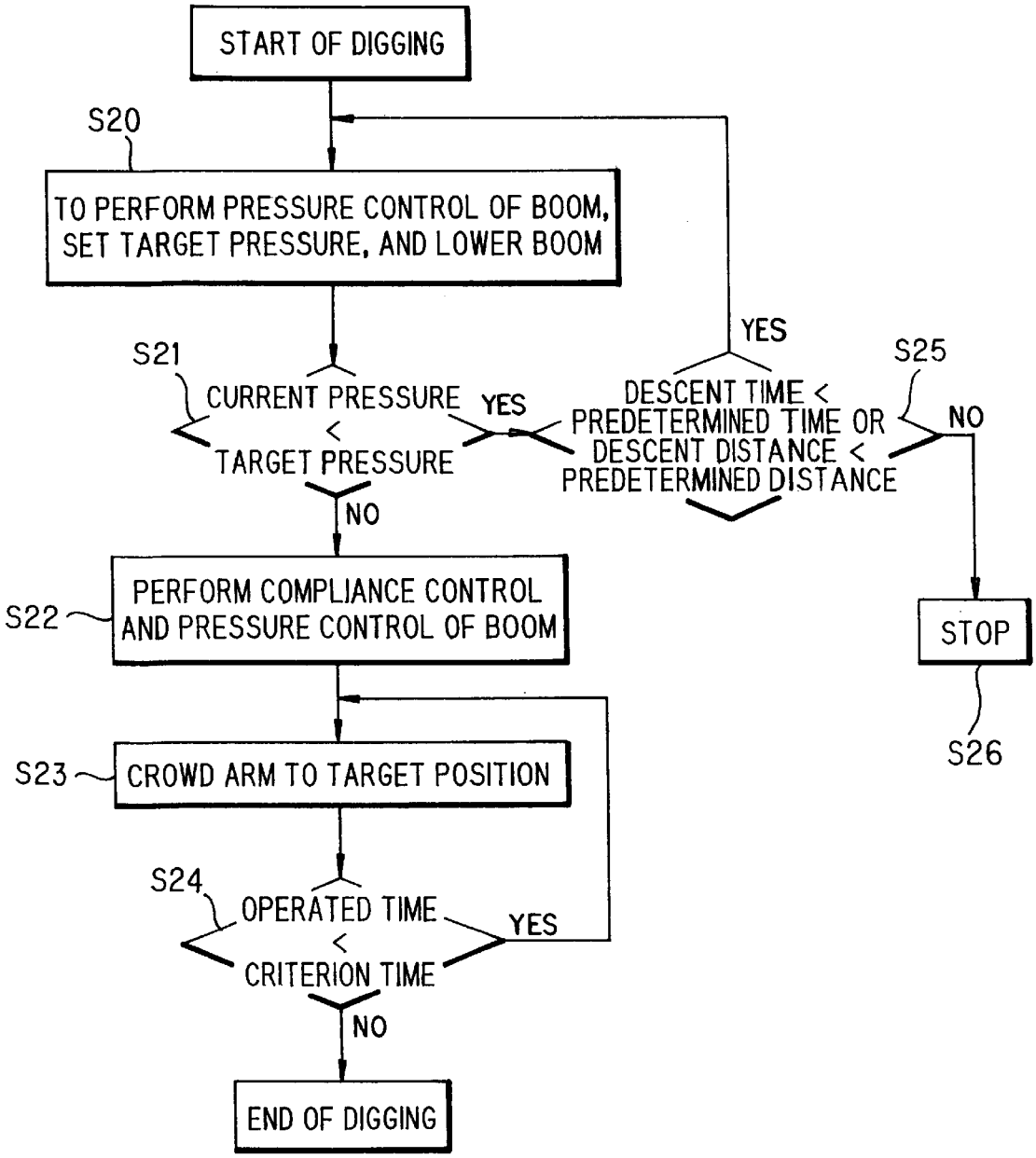
FIG. 7 is a flow chart showing processing procedures by an automatic operation controller in the automatically operated shovel according to the first embodiment of the present invention, said automatically operated shovel having been improved in digging performance.
Figure 8:
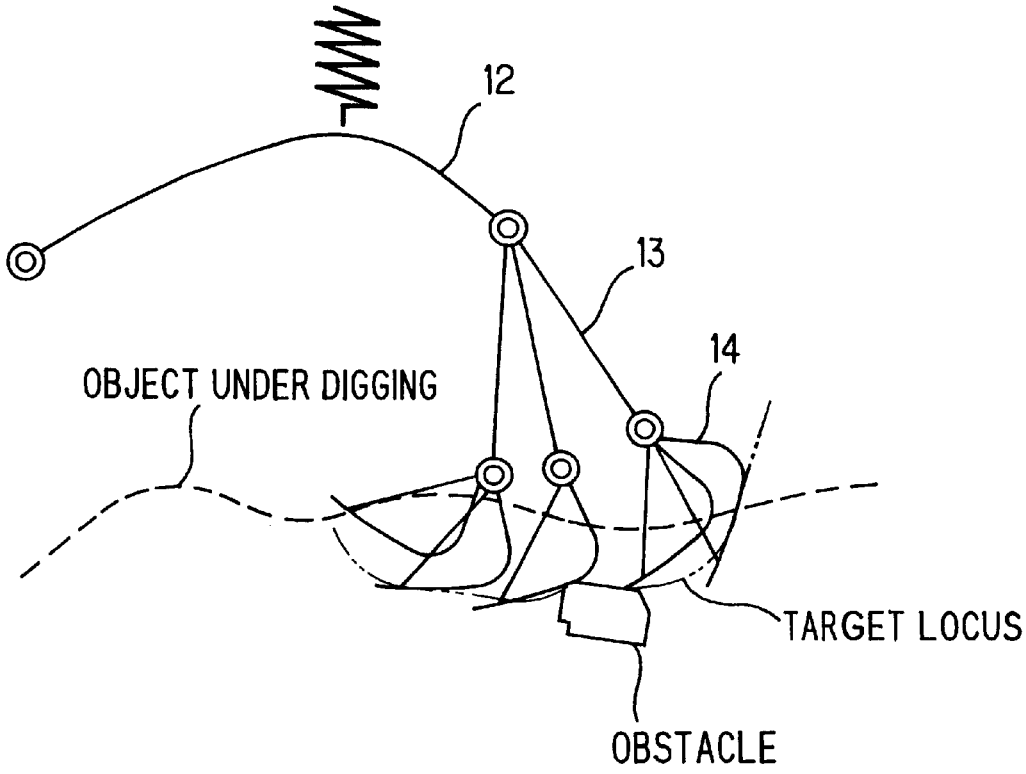
FIG. 8 is a diagram depicting an operation of the automatically operated shovel according to the first embodiment of the present invention during digging, said automatically operated shovel having been improved in digging performance.

Referring next to FIG. 6 through FIG. 8, a description will be made about improved digging performance of the automatically operated shovel according to this embodiment.

To compare the present invention with the conventional art, problems which arise upon digging by the conventional art will be described firstly with reference to FIG. 6.

In FIG. 6, a bucket position MP1 indicates a preparation in which the boom 12 and the arm 13 are extended and the bucket 14 is moved until shortly before it comes into contact with an object under digging. At a bucket position MP2, the boom 12 is then lowered and the bucket 14 begins to contact the object under digging. At a bucket position MP3, the bucket 14 remains in full contact with the object under digging. At a bucket position MP4, the bucket 14 is crowded to start digging the object under digging. At a bucket position MP5, the arm 13 is crowded to perform further digging. At a bucket position MP6, the digging is completed. At a bucket position MP7, the bucket 14 is crowded to a substantially horizontal level such that the dug object is held in the bucket 14. Here, the height of the object under digging is not constant because soil and rocks are not piled flat at the stockyard 2 as illustrated in FIG. 2. Moreover, no fixed locus can be set beforehand for the bucket 14 because soil and rocks are additionally brought to the stockyard 2 by dump trucks or the like and surrounding soil and rocks tend to crumble off after digging. During the digging, the bucket 14 is also jacked up by reaction forces from the object under digging. Even if measures are taken such as changing the operation gains depending on the object under digging, a still further problem may arise such that the percentages of rocks and soil in the object under digging may vary or the object under digging may crumble off and may slide down and enter underneath the bucket 14.

With reference to FIG. 7 and FIG. 8, a description will next be made about processing at the automatic operation controller 6 and also about the operation of the automatically operated shovel main body 1 during digging.

Reference is now had to FIG. 7. When the automatically operated shovel main body 1 reaches a digging position, the routine advances to step 20, in which the control of the boom 12 is changed from position control to pressure control and the boom 12 is lowered until a predetermined pressure is applied to the boom 12. The pressure applied to the boom 12 is determined from signals outputted from the bottom pressure sensor 853 and rod pressure sensor 854 of the boom cylinder 15.

Detection of a pressure can be achieved by simply sensing a contact of the bucket 14 with the object under digging. Representing a bottom pressure of the boom cylinder and a rod pressure of the boom cylinder by Pbb and Pbr, respectively, a current pressure Pn is expressed by Pbb−Pbr. As a computation method of the current pressure Pn, a cylinder thrust (Pbb×Abb)−(Pbf×Abf) may be used as the current pressure Pn by using a bottom-side area Abb and a rod-side area Abr of the cylinder. As the direction of a pressure relied upon detecting the contact while the boom is being lowered is a rod-side pressure, the rod pressure Pbr of the boom cylinder as sensed by the rod pressure sensor 854 can also be used simply as the current pressure Pn.

In step 21, it is determine whether the current pressure Pn of the boom has reached a target pressure Pd. If not, a descent time and a descent distance or angle is calculated in step 25. If the value so calculated falls within a predetermine time range or a predetermined distance or angle range, the routine returns to step 20. If not, certain abnormality is judged to have occurred in the course of the lowering of the boom, and in step 26, the operation is stopped. If the current pressure Pn is found to have reached the target pressure Pd in step 21, the bucket is determined to have begun to contact the object under digging, and the routine then advances to step 22.

In step 22, the servo control of the boom 12 is changed from the pressure control to a combination of compliance and pressure control. As is illustrated in FIG. 8, the boom 12 is hence brought into such as state as being supported by a spring, and the bucket 14 is then allowed to operate by circumventing an obstacle. Owing to the pressure control, a reaction force such as that causing Jack-up of the bucket 14 does not occur. If a load from the object under digging is low, it is possible to perform the digging along the target locus.

In step 23, the arm is crowded to a target position. This arm crowding is performed until a predetermined time elapses. In step 24, an operation time is compared with a criterion time and, if the operation time is not found to have reached the criterion time, the routine returns to step 23. If the operation time is found to have reached the criterion time, the digging is ended.

Figure 9:
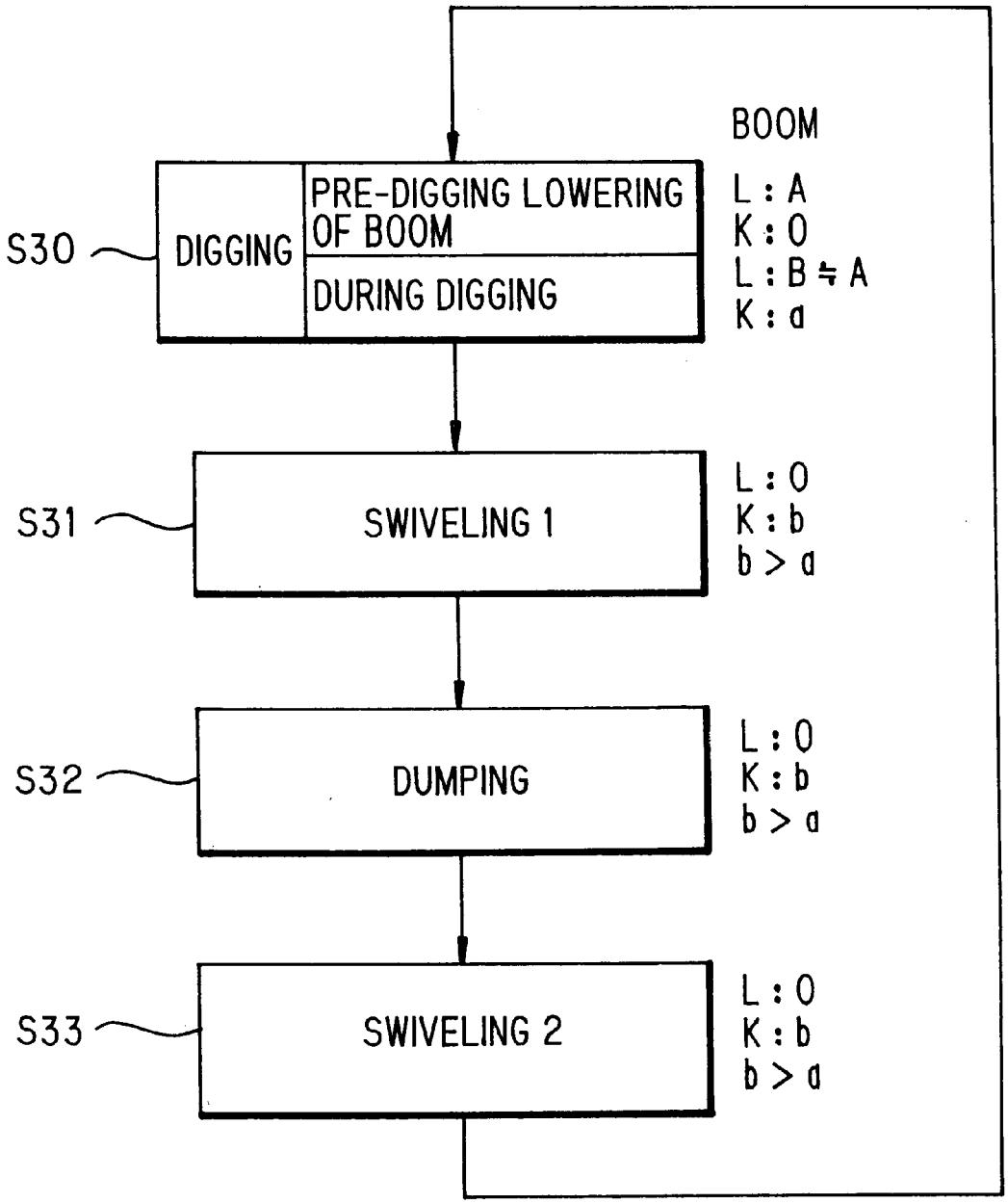
FIG. 9 is a flow chart depicting illustrative setting of a pressure gain L and a stiffness gain K upon servo control of a boom in 1-cycle processing procedures of digging, swiveling 1, dumping and swiveling 2 by the automatically operated shovel according to the first embodiment of the present invention.

Referring next to FIG. 9, a description will be made of setting of the pressure gain L and the stiffness gain K upon servo control of the boom in 1-cycle processing procedures of digging, swiveling 1, dumping and swiveling 2 by the automatically operated shovel according to the first embodiment of the present invention.

Upon performing digging in step 30, the boom is lowered before the digging. This lowering of the boom is performed by setting the pressure gain L at a predetermined value A and the stiffness gain K at 0 or substantially 0 and conducting pressure control as the servo control. Here, the predetermined value A is set at a value where the automatically operated shovel main body 1 is not jacked up. During the digging, the pressure gain L is set at the predetermined pressure A or a value B close to the predetermined value A and the stiffness gain K is set at a predetermined value a, so that the servo control is performed by pressure control and compliance control. The digging is therefore formed such that owing to spring-like actin of the boom 12, the digging remains free from influence of an obstacle contained in the object under digging. During the swiveling 1, dumping and swiveling 2 in step 31 to step 33, compliance control, that is, precise position control is only performed by setting the pressure gain L at 0 and the stiffness gain K at a predetermined value b greater than the value a.

The second embodiment of the present invention will next be described with reference to FIG. 10 and FIG. 11.

The second embodiment is different from the first embodiment in that in addition to the elements and advantages of the first embodiment, the second embodiment also makes it possible to prevent the travel base 10 of the automatically operated shovel main body 1 from skidding in a swiveling direction on the ground.

Figure 10:
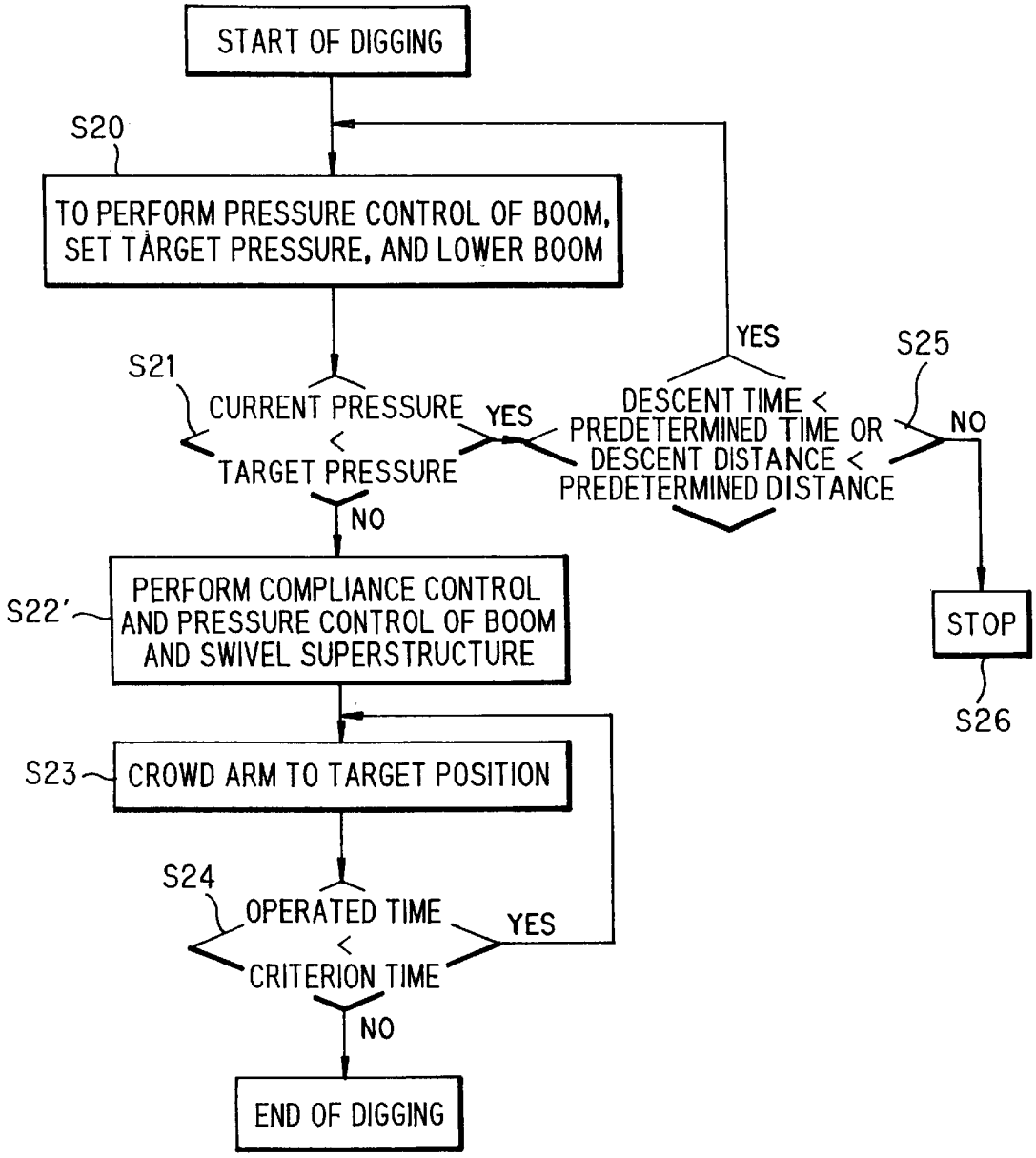
FIG. 10 is a flow chart showing processing procedures by an automatic operation controller in an automatically operated shovel according to a second embodiment of the present invention, said automatically operated shovel having been improved in digging performance and having been applied with a measure for preventing a positional deviation of a shovel during digging.
Figure 11:
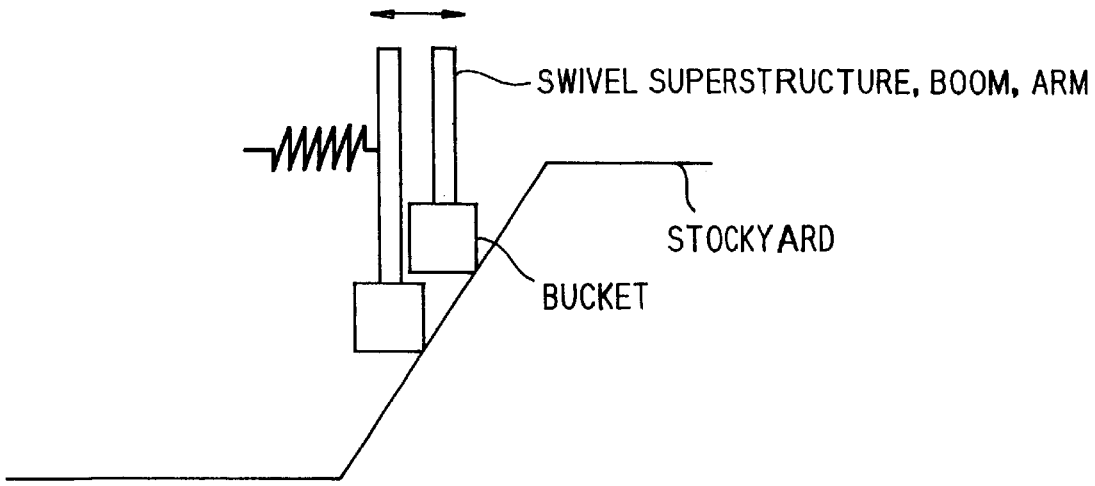
FIG. 11 is a diagram illustrating an operation of the automatically operated shovel according to the second embodiment of the present invention during digging.

With reference to FIG. 10 and FIG. 11, a description will next be made about processing at the automatic operation controller of the automatically operated shovel according to the second embodiment and also about the operation of the automatically operated shovel during digging.

Incidentally, the processings in step 20, step 21 and step 23 to step 26 in FIG. 10 are the same as those in step 20, step 21 and step 23 to step 26 in FIG. 6, so that a description of these processings is omitted herein.

In step 22', the servo control of the boom and swivel superstructure is changed from pressure control to a combination of compliance control and pressure control. As described above in connection with the first embodiment, the boom 12 can therefore be brought into such a state as being supported by a spring, and the bucket 14 can be operated by circumventing obstacles. In addition, if the automatically operated shovel main body 1 is digging as illustrated in FIG. 11, that is, at a position right opposite the paper sheet, the swivel superstructure 11 is brought into a state as being supported by a spring. Even if the bucket 14 descends along a slope of a stockyard during digging, the travel base 10 of the automatically operated shovel main body 1 is free from skidding on the ground in a swiveling direction. As a result, it is possible to avoid skidding of the travel base of the automatically operated shovel main body in the swiveling direction, which may otherwise occur due to a lateral deviation of the bucket along the slope of the stockyard, and hence to avoid a deviation of the automatically operated shovel main body from its operation locus.

Figure 12:
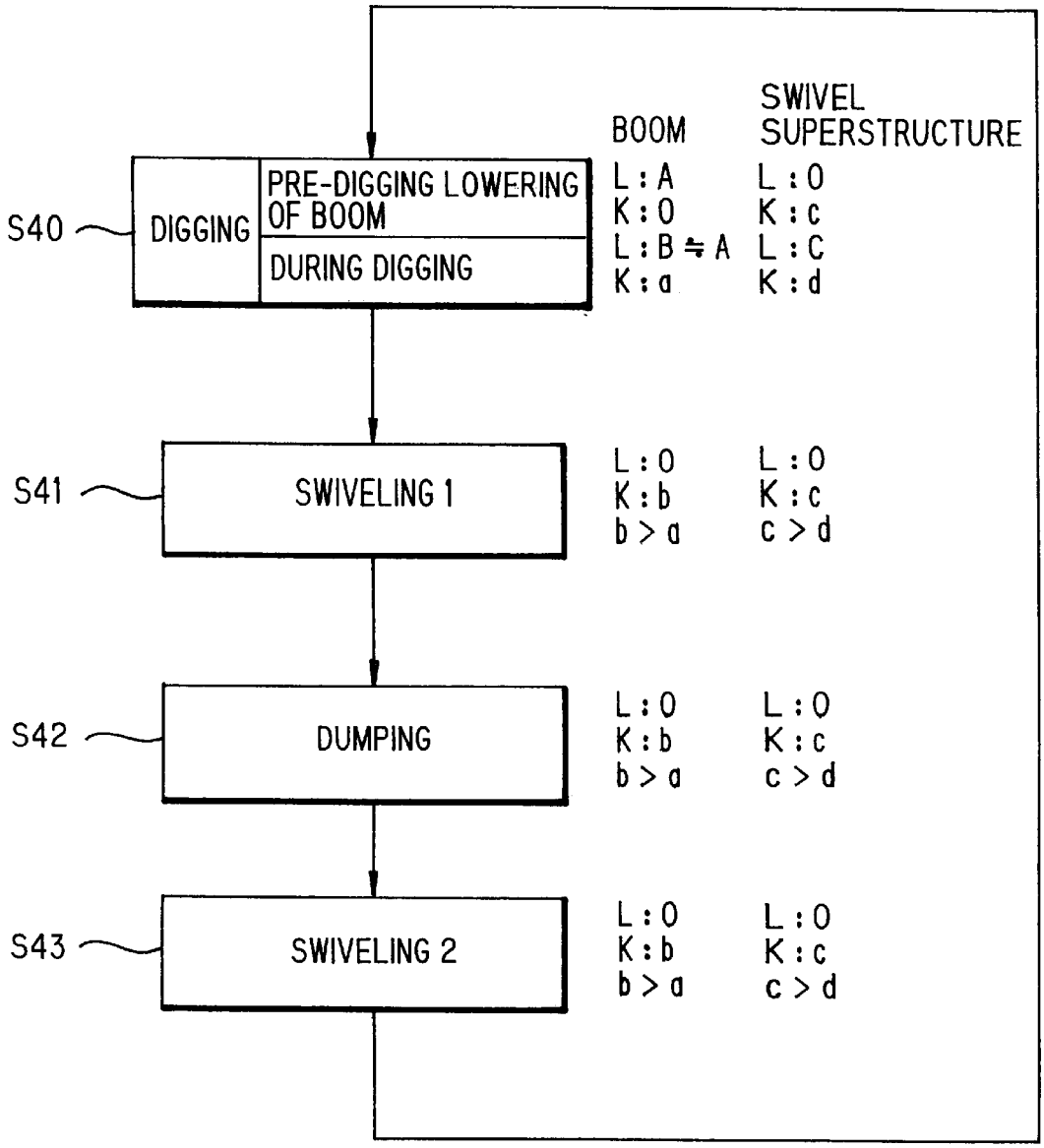
FIG. 12 is a flow chart depicting illustrative setting of a pressure gain L and a stiffness gain K upon servo control of a boom and a swivel superstructure in 1-cycle processing procedures of digging, swiveling 1, dumping and swiveling 2 by the automatically operated shovel according to the second embodiment of the present invention.

Referring next to FIG. 12, a description will be made of setting of the pressure gain L and the stiffness gain K upon servo control of the boom and swivel superstructure in 1-cycle processing procedures of digging, swiveling 1, dumping and swiveling 2 by the automatically operated shovel according to the second embodiment.

As the setting of the pressure gain L and stiffness gain K for the boom is the same as that illustrated in FIG. 9, its description is omitted herein.

Upon performing digging in step 40, the boom is lowered before the digging. This lowering of the boom is performed by setting the pressure gain L for the swivel superstructure at 0 or substantially 0 and the stiffness gain K at a predetermined value c such that as the servo control, compliance control, in other words, precise position control is only performed. During the digging, the pressure gain L is set at a predetermined value C and the stiffness gain K is set at a predetermined value d, so that the servo control is performed by pressure control and compliance control. The swivel superstructure 11 is therefore provided with spring-like nature. Even if a force is applied in the course of the digging in such a way that the bucket 14 is caused to descend along a slope of a stockyard and the swivel superstructure 11 is caused to move in the swiveling direction, this movement can be absorbed to prevent a deviation of the automatically operated shovel main body 1. During the swiveling 1, dumping and swiveling 2 in step 41 to step 43, compliance control, that is, precise position control is only performed by setting the pressure gain L at 0 and the stiffness gain K at a predetermined value c greater than the value d.

What is claimed is:

1. An automatically operated shovel having a shovel and an automatic operation controller arranged on said shovel to store by a teaching operation plural working positions of said shovel, which comprises at least a digging position, and also to cause by a reproduction operation said shovel to repeatedly perform a series of reproduction operations on the basis of said stored plural working positions, wherein:

said automatic operation controller is provided with servo control means for outputting, as a servo control quantity, a sum of a compliance control quantity and a pressure control quantity, said compliance control quantity having been obtained by multiplying with a stiffness gain a difference between a target position of each operational element of said shovel, said target position comprising angle information indicative of an operational target of said operational element, and a current position of said operational element, said current position comprising current angle information on said operational element, and said pressure control quantity having been obtained by multiplying with a pressure gain a difference between a target pressure, which serves as a target when said operational element of said shovel is in contact with an object under digging, and a current pressure of said operational element; and said stiffness gain and said pressure gain are settable at varied values depending on said working positions.

2. An automatically operated shovel according to claim 1, wherein as servo control of a boom at said digging position, pressure control is performed by setting a stiffness gain for said boom at 0 or substantially 0 and a pressure gain for said boom at a first predetermined value before said bucket comes into contact with said object under digging, and compliance control and pressure control are performed by setting said stiffness gain for said boom at a predetermined value and said pressure gain for said boom at a second predetermined value after said bucket has come into contact with said object under digging.

3. An automatically operated shovel according to claim 2, wherein said predetermined value set as said stiffness gain for said boom after said bucket has come into contact with said object under digging is set at a value smaller than a value of said stiffness gain set for said boom at a working position other than said digging position.

4. An automatically operated shovel according to claim 3, wherein a servo control of a swivel superstructure at said digging position, compliance control is performed by setting a stiffness gain for said swivel superstructure at a first predetermined value and a pressure gain for said swivel superstructure at 0 or substantially 0 before said bucket comes into contact with said object under digging, and compliance control and pressure control are performed by setting said stiffness gain for said swivel superstructure at a second predetermined value and said pressure gain for said swivel superstructure at a predetermined value after said bucket has come into contract with said object under digging.

5. An automatically operated shovel according to claim 3, wherein said second predetermined value of said stiffness gain set for said swivel superstructure after said bucket has come into contact with said object under digging is a set at a value smaller than said value of said stiffness set for said swivel superstructure at a working position other than said digging position and said first predetermined value of said stiffness gain for said swivel superstructure.

6. An automatically operated shovel according to claim 2, wherein a servo control of a swivel superstructure at said digging position, compliance control is performed by setting a stiffness gain for said swivel superstructure at a first predetermined value and a pressure gain for said swivel superstructure at 0 or substantially 0 before said bucket comes into contact with said object under digging, and compliance control and pressure control are performed by setting said stiffness gain for said swivel superstructure at a second predetermined value and said pressure gain for said swivel superstructure at a predetermined value after said bucket has come into contract with said object under digging.

7. An automatically operated shovel according to claim 2, wherein said second predetermined value of said stiffness gain set for said swivel superstructure after said bucket has come into contact with said object under digging is a set at a value smaller than said value of said stiffness set for said swivel superstructure at a working position other than said digging position and said first predetermined value of said stiffness gain for said swivel superstructure.

8. An automatically operated shovel according to claim 1, wherein as servo control of a boom at said digging position, pressure control is performed by setting a stiffness gain for said boom at 0 or substantially 0 and a pressure gain for said boom at a first predetermined value before said bucket comes into contact with said object under digging, a time until said bucket comes into contact with said object under digging is measured, and if the time so measured is longer than a predetermined time, an operation of said shovel is stopped.

9. An automatically operated shovel according to claim 8, wherein a servo control of a swivel superstructure at said digging position, compliance control is performed by setting a stiffness gain for said swivel superstructure at a first predetermined value and a pressure gain for said swivel superstructure at 0 or substantially 0 before said bucket comes into contact with said object under digging, and compliance control and pressure control are performed by setting said stiffness gain for said swivel superstructure at a second predetermined value and said pressure gain for said swivel superstructure at a predetermined value after said bucket has come into contract with said object under digging.

10. An automatically operated shovel according to claim 8, wherein said second predetermined value of said stiffness gain set for said swivel superstructure after said bucket has come into contact with said object under digging is a set at a value smaller than said value of said stiffness set for said swivel superstructure at a working position other than said digging position and said first predetermined value of said stiffness gain for said swivel superstructure.

11. An automatically operated shovel according to claim 1, wherein as servo control of a boom at said digging position, pressure control is performed by setting a stiffness gain for said boom at 0 or substantially 0 and a pressure gain for said boom at a first predetermined value before said bucket comes into contact with said object under digging, a distance or angle until said bucket comes into contact with said object under digging is measured, and if said distance or angle so measured is greater than a predetermined distance or a predetermined angle, an operation of said shovel is stopped.

12. An automatically operated shovel according to claim 11, wherein a servo control of a swivel superstructure at said digging position, compliance control is performed by setting a stiffness gain for said swivel superstructure at a first predetermined value and a pressure gain for said swivel superstructure at 0 or substantially 0 before said bucket comes into contact with said object under digging, and compliance control and pressure control are performed by setting said stiffness gain for said swivel superstructure at a second predetermined value and said pressure gain for said swivel superstructure at a predetermined value after said bucket has come into contract with said object under digging.

13. An operation method according to claim 16, wherein servo control of a swivel superstructure at said digging position comprises the following steps:

performing compliance control by setting a stiffness gain for said swivel superstructure at a first predetermined value and a pressure gain for said swivel superstructure at 0 or substantially 0 before said bucket comes into contact with said object under digging; and performing compliance control and pressure control by setting said stiffness gain for said swivel superstructure at a second predetermined value and said pressure gain for said swivel superstructure at a predetermined value after said bucket has come into contact with said object under digging.

14. An automatically operated shovel according to claim 1, wherein as servo control of a swivel superstructure at said digging position, compliance control is performed by setting a stiffness gain for said swivel superstructure at a first predetermined value and a pressure gain for said swivel superstructure at 0 or substantially 0 before said bucket comes into contact with said object under digging, and compliance control and pressure control are performed by setting said stiffness gain for said swivel superstructure at a second predetermined value and said pressure gain for said swivel superstructure at a predetermined value after said bucket has come into contact with said object under digging.

15. An automatically operated shovel according to claim 1, wherein said second predetermined value of said stiffness gain set for said swivel superstructure after said bucket has come into contact with said object under digging is set at a value smaller than said value of said stiffness set for said swivel superstructure at a working position other than said digging position and said first predetermined value of said stiffness gain for said swivel superstructure.

16. An operation method of an automatically operated shovel having a shovel and an automatic operation controller arranged on said shovel to store by a teaching operation plural working positions of said shovel, which comprises at least a digging position, and also to cause by a reproduction operation said shovel to repeatedly perform a series of reproduction operations on the basis of said stored plural working positions, said automatic operation controller is provided with servo control means for outputting, as a servo control quantity, a sum of a compliance control quantity and a pressure control quantity, said compliance control quantity having been obtained by multiplying with a stiffness gain a difference between a target position of each operational element of said shovel, said target position comprising angle information indicative of an operational target of said operational element, and a current position of said operational element, said current position comprising current angle information on said operational element, and said pressure control quantity having been obtained by multiplying with a pressure gain a difference between a target pressure, which serves as a target when said operational element of said shovel is in contact with an object under digging, wherein servo control of a boom at said digging position comprises the following steps:

performing pressure control by setting a stiffness gain for said boom at 0 or substantially 0 and a pressure gain for said boom at a first predetermined value before said bucket comes into contact with said object under digging; and performing compliance control and pressure control by setting said stiffness gain for said boom at a predetermined value and said pressure gain for said boom at a second predetermined value after said bucket has come into contact with said object under digging.

17. An operation method according to claim 16, wherein said predetermined value set as said stiffness gain for said boom after said bucket has come into contact with said object under digging is set at a value smaller than a value of said stiffness gain set for said boom at a working position other than said digging position.

18. An operation method according to claim 17, wherein servo control of a swivel superstructure at said digging position comprises the following steps:

performing compliance control by setting a stiffness gain for said swivel superstructure at a first predetermined value and a pressure gain for said swivel superstructure at 0 or substantially 0 before said bucket comes into contact with said object under digging; and performing compliance control and pressure control by setting said stiffness gain for said swivel superstructure at a second predetermined value and said pressure gain for said swivel superstructure at a predetermined value after said bucket has come into contact with said object under digging.

19. An operation method according to claim 16, wherein in the step in which said pressure control is performed with said pressure gain for said boom being set at said first predetermined value, a time until said bucket comes into contact with said object under digging is measured, and if the time so measured is longer than a predetermined time, an operation of said shovel is stopped.

20. An operation method according to claim 19, wherein servo control of a swivel superstructure at said digging position comprises the following steps:

performing compliance control by setting a stiffness gain for said swivel superstructure at a first predetermined value and a pressure gain for said swivel superstructure at 0 or substantially 0 before said bucket comes into contact with said object under digging; and performing compliance control and pressure control by setting said stiffness gain for said swivel superstructure at a second predetermined value and said pressure gain for said swivel superstructure at a predetermined value after said bucket has come into contact with said object under digging.

21. An operation method according to claim 16, wherein in the step in which said pressure control is performed with said pressure gain for said boom being set at said first predetermined value, a distance or angle until said bucket comes into contact with said object under digging is measured, and if the distance or angle so measured is greater than a predetermined distance or a predetermined angle, an operation of said shovel is stopped.

22. An operation method according to claim 21, wherein servo control of a swivel superstructure at said digging position comprises the following steps:

performing compliance control by setting a stiffness gain for said swivel superstructure at a first predetermined value and a pressure gain for said swivel superstructure at 0 or substantially 0 before said bucket comes into contact with said object under digging; and performing compliance control and pressure control by setting said stiffness gain for said swivel superstructure at a second predetermined value and said pressure gain for said swivel superstructure at a predetermined value after said bucket has come into contact with said object under digging.

23. An automatically operated shovel according to claim 11, wherein said second predetermined value of said stiffness gain set for said swivel superstructure after said bucket has come into contact with said object under digging is a set at a value smaller than said value of said stiffness set for said swivel superstructure at a working position other than said digging position and said first predetermined value of said stiffness gain for said swivel superstructure.

24. An operation method according to claim 13, wherein said second predetermined value of said stiffness gain set for said swivel superstructure after said bucket has come into contact with said object under digging is set at a value smaller than said value of said stiffness set for said swivel superstructure at a working position other than said digging position and said first predetermined value of said stiffness gain for said swivel superstructure.

* * * * *